US012270180B2

(12) United States Patent
Meschke et al.

(10) Patent No.: US 12,270,180 B2
(45) Date of Patent: Apr. 8, 2025

(54) PNEUMATIC EXCAVATOR AND METHODS OF USE

(71) Applicant: Sonny's HFI Holdings, LLC, Wilmington, DE (US)

(72) Inventors: Timothy Meschke, Carver, MN (US); Ian Taylor, Inver Grove Heights, MN (US); Nathan Schlueter, Bloomington, MN (US)

(73) Assignee: Sonny's HFI Holdings, LLC, Wilmington, DE (US)

( * ) Notice: Subject to any disclaimer, the term of this patent is extended or adjusted under 35 U.S.C. 154(b) by 0 days.

(21) Appl. No.: 18/416,050

(22) Filed: Jan. 18, 2024

(65) Prior Publication Data

US 2024/0254723 A1 Aug. 1, 2024

Related U.S. Application Data

(60) Provisional application No. 63/441,966, filed on Jan. 30, 2023.

(51) Int. Cl.
*E02F 3/00* (2006.01)
*E02F 3/88* (2006.01)
(Continued)

(52) U.S. Cl.
CPC ..... *E02F 3/902* (2013.01); *E02F 3/8891* (2013.01); *E02F 3/9206* (2013.01)

(58) Field of Classification Search
CPC ..... E02F 3/92; E02F 3/9206; E02F 3/9218; E02F 3/925; E02F 3/9262; E02F 5/287;
(Continued)

(56) References Cited

U.S. PATENT DOCUMENTS 521,883 A * 6/1894 Holland ..... E02F 3/925 37/322
3,125,819 A * 3/1964 Kaufmann ..... E02F 3/907 37/309

(Continued)

FOREIGN PATENT DOCUMENTS

EP 0251660 A1 1/1988
EP 0566543 A1 10/1993

(Continued)

OTHER PUBLICATIONS

Invitation to Pay Additional Fees dated Apr. 26, 2024 in connection with International Patent Application No. PCT/US2024/013280, 4 pages.

(Continued)

*Primary Examiner* — Edwin J Toledo-Duran
(74) *Attorney, Agent, or Firm* — Dorsey & Whitney LLP

(57) ABSTRACT

A pneumatic excavator is configured to be pneumatically actuated using a safety mechanism, and includes a primary actuator; a secondary actuator fluidly coupled to the primary actuator; a flow valve fluidly coupled to the primary actuator; a shuttle valve fluidly coupled to the primary actuator, the secondary actuator and the flow valve; and a barrel coupled to an egress of the flow valve, the barrel defining an outlet of the pneumatic excavator. Actuating the primary and secondary actuators causes compressed air to be transmitted from the secondary actuator to the primary actuator and then to the flow valve to open the flow valve such that the compressed air exits through the outlet. Actuating one actuator and not the other causes the compressed air to be transmitted to the exit port of the shuttle valve and then to the flow valve to close the flow valve and prevent air flow therethrough.

20 Claims, 12 Drawing Sheets

(51) Int. Cl.
*E02F 3/90* (2006.01)
*E02F 3/92* (2006.01)

(58) Field of Classification Search
CPC ..... E02F 3/00; E02F 3/04; E02F 3/88; E02F 3/90; E02F 3/902; E02F 3/8891; B08B 5/00; B08B 5/02
See application file for complete search history.

(56) References Cited

U.S. PATENT DOCUMENTS 3,670,514 A * 6/1972 Breston ..... E02F 5/109 405/160
3,881,530 A * 5/1975 Faldi ..... B63B 35/303 414/137.9
4,114,723 A * 9/1978 Paitson ..... G01V 1/137 181/119
4,176,487 A 12/1979 Manis
4,253,255 A * 3/1981 Durell ..... E02F 3/925 417/125
4,331,140 A * 5/1982 Hallsey ..... A61M 16/20 128/205.24
4,377,168 A * 3/1983 Rzasa ..... F25B 9/02 606/26
4,412,656 A 11/1983 Beck
4,936,031 A 6/1990 Briggs et al.
4,991,321 A 2/1991 Artzberger
5,016,717 A * 5/1991 Simons ..... E02F 5/003 405/249
5,140,759 A 8/1992 Artzberger
5,170,943 A * 12/1992 Artzberger ..... E02F 3/9206 239/290
5,186,392 A 2/1993 Pleshek
5,212,891 A 5/1993 Schuermann et al.
5,220,935 A * 6/1993 Bailey ..... B05B 3/001 134/102.1
5,244,364 A * 9/1993 Laco ..... F04B 5/02 417/540
5,263,504 A * 11/1993 Bailey ..... B05B 3/001 134/172
5,487,229 A * 1/1996 Nathenson ..... E02F 3/94 406/171
5,782,414 A 7/1998 Nathenson
5,785,067 A * 7/1998 Kosofsky ..... B60S 3/044 134/102.1
5,803,982 A * 9/1998 Kosofsky ..... B08B 3/08 134/182
5,806,616 A * 9/1998 Enlund ..... B60G 17/005 280/755
5,832,974 A * 11/1998 Jou ..... B08B 5/02 141/38
5,860,232 A * 1/1999 Nathenson ..... E02F 5/003 175/215
5,966,847 A * 10/1999 Nathenson ..... E02F 3/9206 137/874
5,976,268 A * 11/1999 Eliason ..... B08B 3/026 134/102.1
5,993,117 A * 11/1999 Lancaster ..... B08B 9/0557 406/3
5,996,847 A * 12/1999 Smolen, Jr. ..... B05B 11/1084 222/137
D435,207 S 12/2000 Nathenson et al.
6,158,152 A * 12/2000 Nathenson ..... E02F 3/9206 239/532
6,202,330 B1 * 3/2001 Bolton ..... B01D 50/20 37/195
6,283,340 B1 * 9/2001 Waldner ..... B05B 1/005 222/530
6,397,878 B1 * 6/2002 Nolan ..... E03C 1/108 137/218
6,470,605 B1 * 10/2002 Gilman ..... E21B 7/18 37/323
6,615,849 B1 * 9/2003 Gilman ..... E02F 3/8816 134/167 R
6,618,966 B2 * 9/2003 Russo ..... E02F 3/9206 175/212
7,475,831 B2 1/2009 Van et al.
7,631,444 B1 12/2009 Hursen
7,676,965 B1 3/2010 Nathenson et al.
7,677,476 B2 * 3/2010 Burdsall ..... B08B 3/026 239/525
9,056,328 B2 6/2015 Giovannini
9,382,688 B2 7/2016 Buckner
9,475,174 B2 10/2016 Hursen
9,855,573 B2 1/2018 Hursen
D865,120 S 10/2019 Tibell et al.
10,603,780 B2 3/2020 Hursen
10,792,681 B2 10/2020 Alves
10,920,397 B2 2/2021 Buchleiter et al.
11,278,940 B2 3/2022 Takada et al.
2006/0065309 A1 * 3/2006 Leasure ..... F04B 41/02 137/565.18
2008/0040945 A1 * 2/2008 Buckner ..... E02F 3/8891 34/406
2009/0255272 A1 10/2009 Tibell
2009/0284068 A1 * 11/2009 Yu ..... E02F 5/006 299/10
2010/0095559 A1 * 4/2010 Buckner ..... E02F 3/8825 37/304
2010/0196129 A1 * 8/2010 Buckner ..... E02F 3/8825 15/340.1
2011/0296646 A1 * 12/2011 Showley ..... E02F 3/9243 15/327.1
2012/0007009 A1 * 1/2012 Yie ..... F16K 31/1221 251/321
2013/0185966 A1 * 7/2013 Harrington ..... E02F 3/9206 37/466
2013/0189060 A1 * 7/2013 Lamonte ..... E02F 3/8825 414/507
2013/0340297 A1 * 12/2013 Buckner ..... E02F 3/925 37/304
2014/0020268 A1 1/2014 Buckner
2014/0130382 A1 5/2014 Harrington
2014/0231326 A1 * 8/2014 Biley ..... E02B 15/10 210/170.01
2015/0176243 A1 * 6/2015 Buckner ..... E02F 3/90 137/544
2016/0207057 A1 7/2016 Hursen
2020/0070180 A1 3/2020 Tibell
2023/0080378 A1 3/2023 Richter et al.
2024/0254724 A1 8/2024 Meschke et al.
2024/0254725 A1 8/2024 Meschke et al.
2024/0254726 A1 8/2024 Meschke et al.

FOREIGN PATENT DOCUMENTS

EP 1803980 A1 7/2007
WO 2017217916 A1 12/2017
WO 2024163314 A2 8/2024

OTHER PUBLICATIONS

International Search Report and Written Opinion dated Jul. 10, 2024 in connection with International Patent Application No. PCT/US2024/013280, 17 pages.

* cited by examiner

PNEUMATIC EXCAVATOR AND METHODS OF USE

CROSS-REFERENCE TO RELATED APPLICATIONS

This application claims the benefit of U.S. Provisional Patent Application No. 63/441,966, filed Jan. 30, 2023, entitled "PNEUMATIC EXCAVATOR AND METHODS OF USE", which relates to commonly owned U.S. Provisional Patent Application No. 63/441,954, filed Jan. 30, 2023, entitled "PNEUMATIC EXCAVATOR AND METHODS OF USE", U.S. Provisional Patent Application No. 63/441,957, filed Jan. 30, 2023, entitled "PNEUMATIC EXCAVATOR AND METHODS OF USE", and U.S. Provisional Patent Application No. 63/441,961, filed Jan. 30, 2023, entitled "PNEUMATIC EXCAVATOR AND METHODS OF USE", each of which are herein incorporated by reference in their entireties for any useful purpose.

TECHNICAL FIELD

Implementations are directed to excavators, and more particularly to hand-held pneumatic excavators and methods of use.

BACKGROUND

Compressed air excavators cause compressed air to exit from a nozzle disposed at an end of an open pipe, which may be useful in operations such as loosening soil from buried pipes, gas mains, cables and cleaning. In prior approaches, pressurized water directed at the soil resulted in the generation of hazardous waste by the water mixing with contaminants in the soil that requires special treatment prior to disposal. In other approaches, mechanical digging implements such as blades and picks having hard cutting edges often damage the objects to be excavated or cleaned. The use of compressed air has the advantage of avoiding generation of hazardous waste while loosening soil without causing damage to the object targeted.

SUMMARY

A pneumatic excavator configured to be pneumatically actuated is thus provided. According to implementations, a pneumatic excavator includes a primary actuator; a secondary actuator fluidly coupled to the primary actuator; a shuttle valve may include a first inlet port fluidly coupled to a delivery port of the primary actuator, a second inlet port fluidly coupled to a delivery port of the secondary actuator; a flow valve may include a first port fluidly coupled to the primary actuator by at least one air actuation conduit and a second port fluidly coupled to an exit port of the shuttle valve; a barrel coupled to an egress of the flow valve, where an egress of the barrel defines an outlet of the pneumatic excavator. A primary flow passage may be defined at least by the flow valve and the barrel. Actuating the primary actuator and the secondary actuator causes compressed air to be transmitted from the secondary actuator to the primary actuator and through the at least one air actuation conduit to the first port of the flow valve to cause the flow valve to move to an open position such that the compressed air from the supply of compressed air passes through the primary flow passage and exits through the outlet of the pneumatic excavator. Then, when actuating one of the primary actuator or the secondary actuator and not actuating the other, causes the compressed air to be transmitted to the exit port of the shuttle valve fluidly coupled to the second port of the flow valve to cause the flow valve to move to a closed position, where in the closed position, the flow valve prevents the compressed air from the supply of compressed air from passing therethrough.

In various implementations and alternatives, a constant pressure conduit may be included, where a first end of the constant pressure conduit may be coupled to the pneumatic excavator at an upstream position from an egress of the flow valve, and a second end of the constant pressure conduit may be coupled to the secondary actuator.

In such implementations and alternatives, an air conduit may be provided that fluidly couples the primary actuator to the secondary actuator, where when the secondary actuator is actuated, the air conduit may be fluidly coupled to the constant pressure conduit. In addition or alternatively, the primary actuator further includes a primary actuator valve, and as the secondary actuator is actuated and when the primary actuator is actuated, the primary actuator valve may be configured to fluidly couple the constant pressure conduit to the first port of the flow valve. In addition or alternatively, as the secondary actuator is actuated and the primary actuator is not actuated, the delivery port of the primary actuator fluidly couples the air conduit to the first inlet port of the shuttle valve.

In implementations alternatives including the constant pressure conduit, the secondary actuator may further include a secondary actuator valve, where when the primary actuator is actuated and the secondary actuator is not actuated, the delivery port of the secondary actuator valve may be configured to fluidly couple the constant pressure conduit to the second inlet port of the shuttle valve.

In various implementations and alternatives, when neither the primary actuator nor the secondary actuator are actuated, the secondary actuator may be configured to transmit the compressed air via the delivery port to the second inlet port of the shuttle valve such that the flow valve is retained in the closed position or caused to move to the closed position, where in the closed position, the flow valve prevents the compressed air from the supply of compressed air from passing therethrough.

In various implementations and alternatives, at least one of the primary actuator or the secondary actuator may include a spool valve having a spool biased by a biasing mechanism. In such implementations and alternatives, the biasing mechanism may include a return spring.

In various implementations and alternatives, in the closed position of the flow valve, a piston of the flow valve may seal against a valve seat.

In various implementations and alternatives, at least one vent port may be included and configured to vent compressed air from the flow valve. In such implementations and alternatives, at least one vent port may be defined in the primary actuator or the secondary actuator.

In various implementations and alternatives, the flow valve may be free of a biasing mechanism such that the flow valve requires the compressed air to move the flow valve to the open position and to the closed position.

According to other implementations, a method of pneumatically actuating a pneumatic excavator may involve supplying compressed air to a pneumatic excavator from a compressed air supply, the pneumatic excavator may include an elongated barrel, a primary actuator, a secondary actuator, and a flow valve, the elongated barrel having an ingress and an egress, said ingress configured to be fluidly connected to the supply of compressed air, said egress defining an outlet of the pneumatic excavator, the primary actuator may include at least one air actuation conduit and the primary actuator configured to be fluidly coupled to a shuttle valve, the secondary actuator fluidly coupled to the primary actuator and to the shuttle valve, the flow valve fluidly coupled to the primary actuator and to the shuttle valve, where a primary flow passage is defined at least by the flow valve and the barrel. The primary actuator and the secondary actuator may be actuated to cause compressed air to be transmitted from the secondary actuator to the primary actuator to the flow valve to cause the flow valve to move to an open position such that the compressed air from the supply of compressed air passes through the primary flow passage and exits through the outlet of the pneumatic excavator. Then one of the primary actuator or the secondary actuator may be actuated while the other is not actuated, causing the compressed air to be transmitted to the shuttle valve to the flow valve to cause the flow valve to move to a closed position such that the compressed air from the supply of compressed air may be prevented from passing through the flow valve.

In various implementations and alternatives, during the supplying of compressed air, compressed air may be constantly delivered to a constant pressure conduit fluidly coupled to an intake port of the secondary actuator. In such implementations and alternatives, the actuating of one and not the other, involves actuating the secondary actuator and not the primary actuator, and where the air actuation conduit further includes a first air actuation conduit fluidly coupling the primary actuator and the secondary actuator such that the compressed air may be constantly delivered to the air actuation conduit and to the primary actuator.

In addition or alternatively, the air actuation conduit may further include a first air actuation conduit and a second air actuation conduit, and during the actuating of the primary actuator and the secondary actuator, the first air actuation conduit may fluidly couple the primary actuator and the secondary actuator such that the compressed air may be constantly delivered to the first air actuation conduit and to the primary actuator, and the second air actuation conduit fluidly couples the primary actuator and the flow valve such that the compressed air may be constantly delivered from the primary actuator to the flow valve. In addition or alternatively, actuating one actuator and not the other includes actuating the primary actuator and not the secondary actuator, and the secondary actuator further includes an air conduit fluidly coupling a delivery port of the secondary actuator and the shuttle valve such that the compressed air may be constantly delivered to the shuttle valve via the air conduit.

In various implementations and alternatives, during actuation of one of the primary actuator or the secondary actuator and not the other, the shuttle valve may allow air to enter an entry port from the actuated actuator and prevents air from entering the shuttle valve from the other unactuated actuator.

In various implementations and alternatives, the flow valve may be free of a biasing mechanism such that the flow valve requires the compressed air to move the flow valve to the open position and to the closed position.

DETAILED DESCRIPTION

Figure 1:
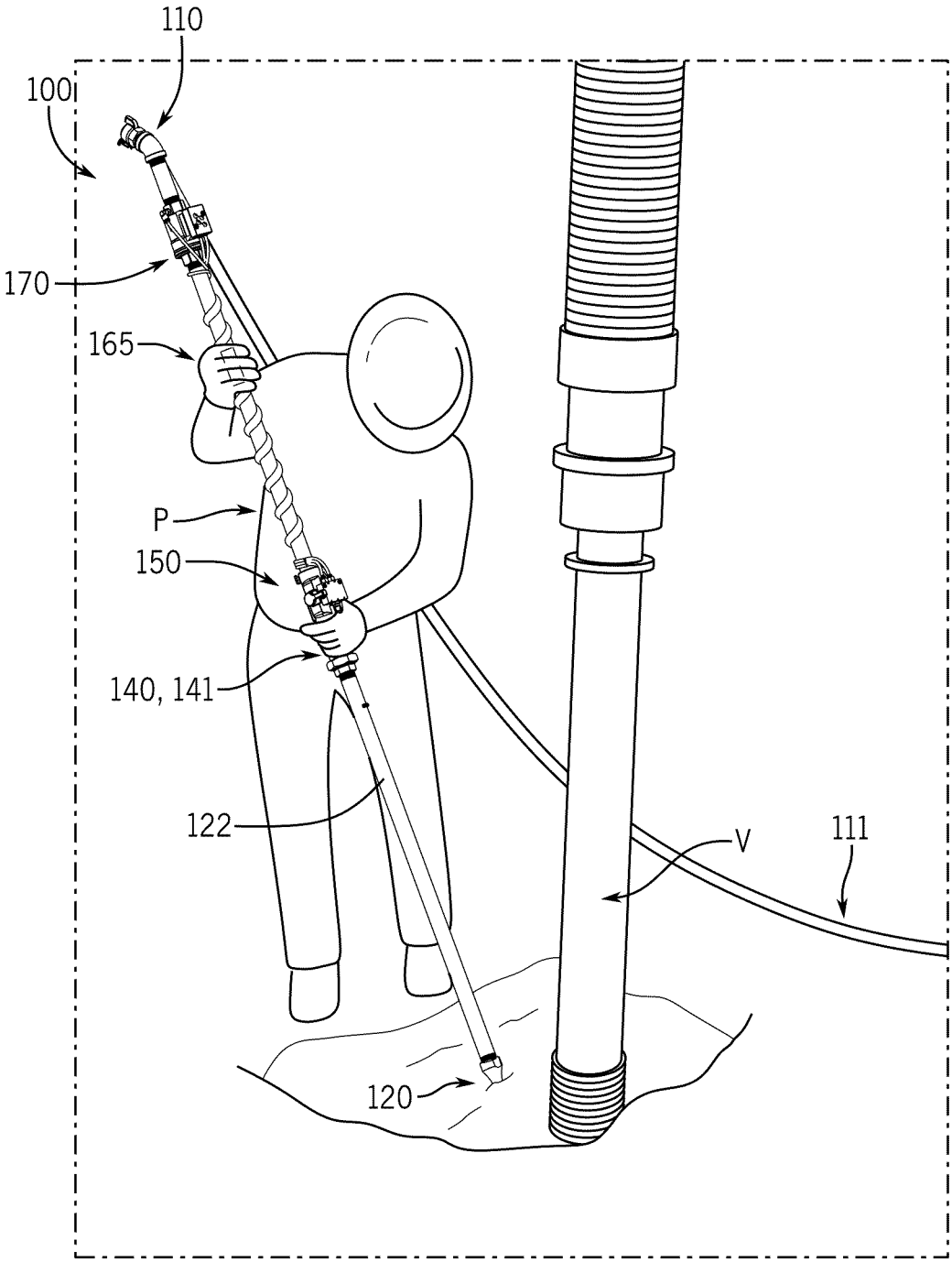
FIG. 1 illustrates a pneumatic air excavator in use in an excavating operation, according to implementations of the present disclosure.

Turning to the Figures, FIG. 1 illustrates a pneumatic air excavator 100 of the present disclosure in an exemplary soil excavating operation. A proximal end 110 of the pneumatic air excavator 100 is removably coupled to an air supply via an elongated delivery line 111. The air supply may be compressed or pressurized air, which may be provided by an air compressor such as an air compressor truck. The air supply may be air (e.g., a mixture of oxygen and nitrogen), a gas or a mixture. A distal end 120 of the pneumatic air excavator 100 may include an extension 122 and a nozzle 130 (see, e.g., FIG. 2A) configured to deliver the compressed air, for instance, to break apart soil covering a buried target object, e.g., a pipe, cable, or other structure(s). A barrel 140 extending between the proximal and distal end 110, 120 of the pneumatic air excavator 100 may be held by a user P during use. The barrel 140 may include an actuator assembly 150 movably coupled to an exterior 141 of the barrel 140 by a releasable coupling 160 (see, e.g., FIG. 2A). The actuator assembly 150 may be held by one hand of the user P for controlling an on/off status of the pneumatic air excavator 100, while a different region of the pneumatic air excavator 100 may be held by the other hand of the user P, such as at a safety mechanism 165 proximate a primary valve or flow valve 170. As the soil is loosened during operation of the pneumatic air excavator 100, an industrial vacuum V may extract the loosened soil and may for instance deposit the soil in a location for future use or removal.

Figure 2A:
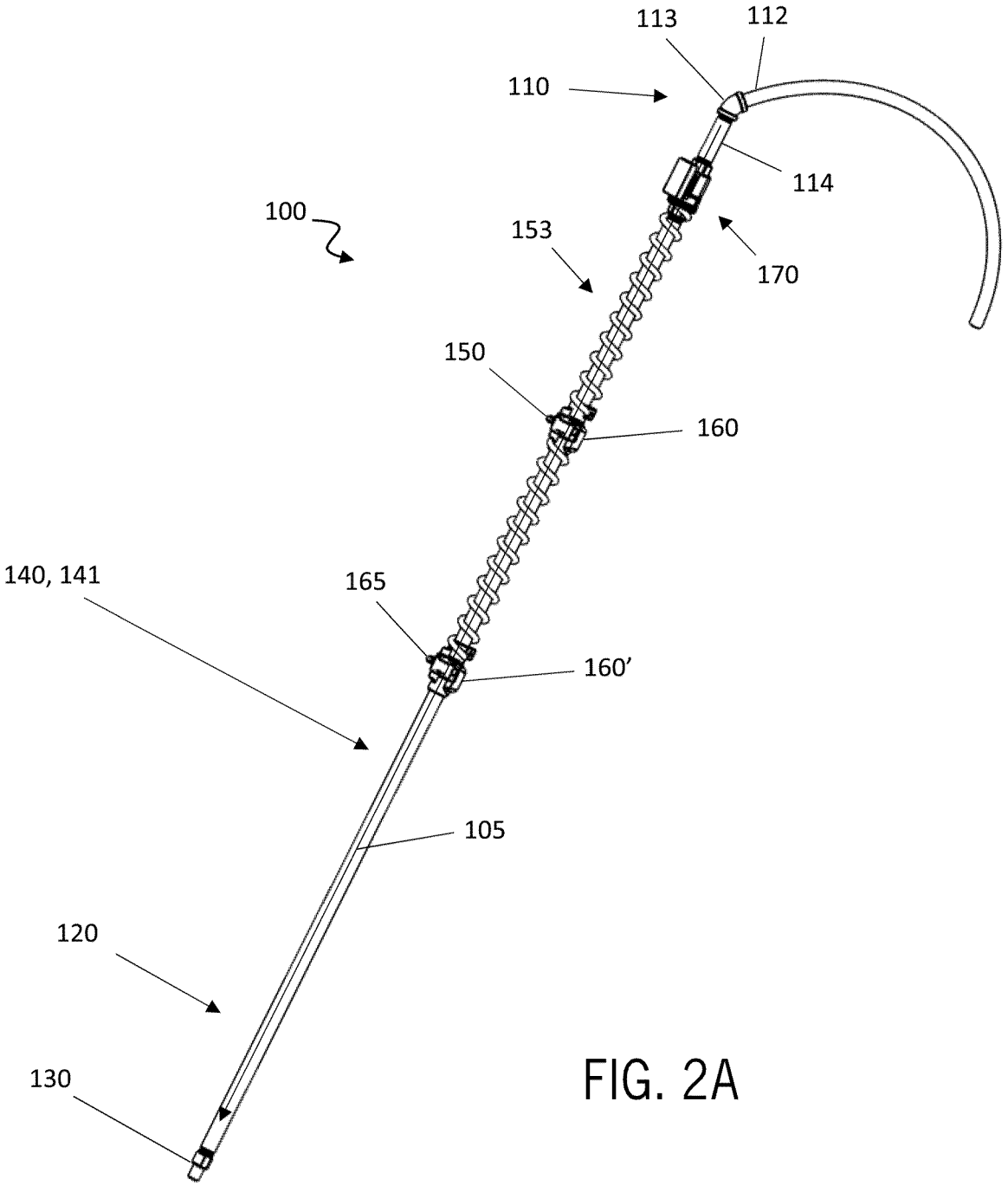
FIGS. 2A, 2B and 2C illustrate a first isometric view, an exploded isometric view, and a second isometric view, respectively, of the pneumatic air excavator, according to implementations of the present disclosure.
Figure 2B:
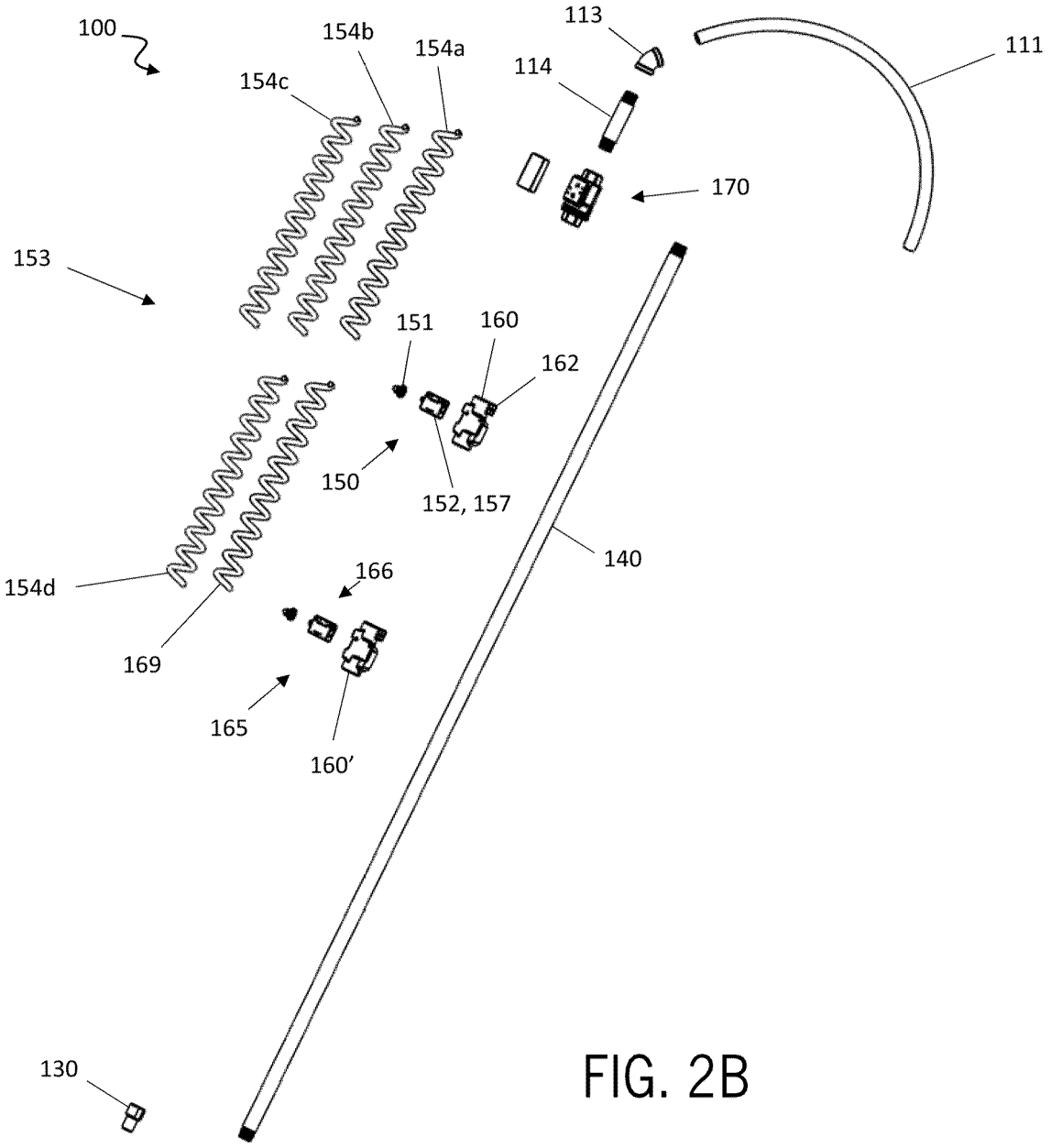

FIGS. 2A and 2B illustrate an isometric view and an exploded isometric view, respectively, of the pneumatic air excavator 100 of the present disclosure. As shown in FIG. 2A, components of the pneumatic air excavator 100 may be coaxially arranged such as the nozzle 130, barrel 140, portions of the actuator assembly 150, the releasable coupling 160, a safety mechanism 165 and the primary flow valve 170. A primary flow passage 105 of the pneumatic air excavator 100 may extend along a central axis thereof and may be defined at least by the flow valve 170, the barrel 140 and nozzle 130.

Figure 2C:
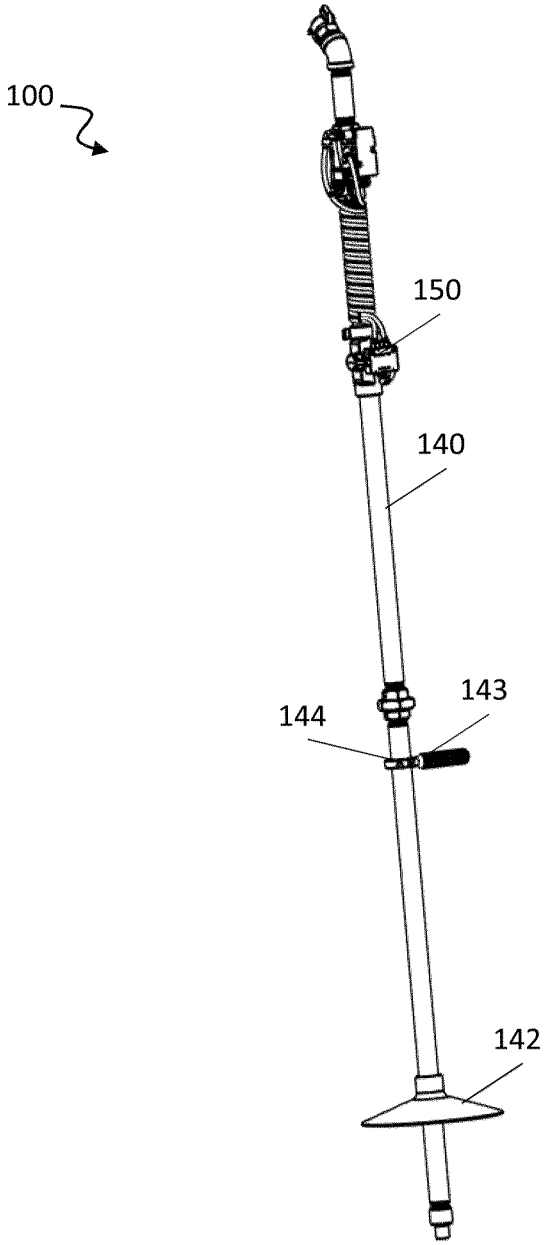
Figure 2D:
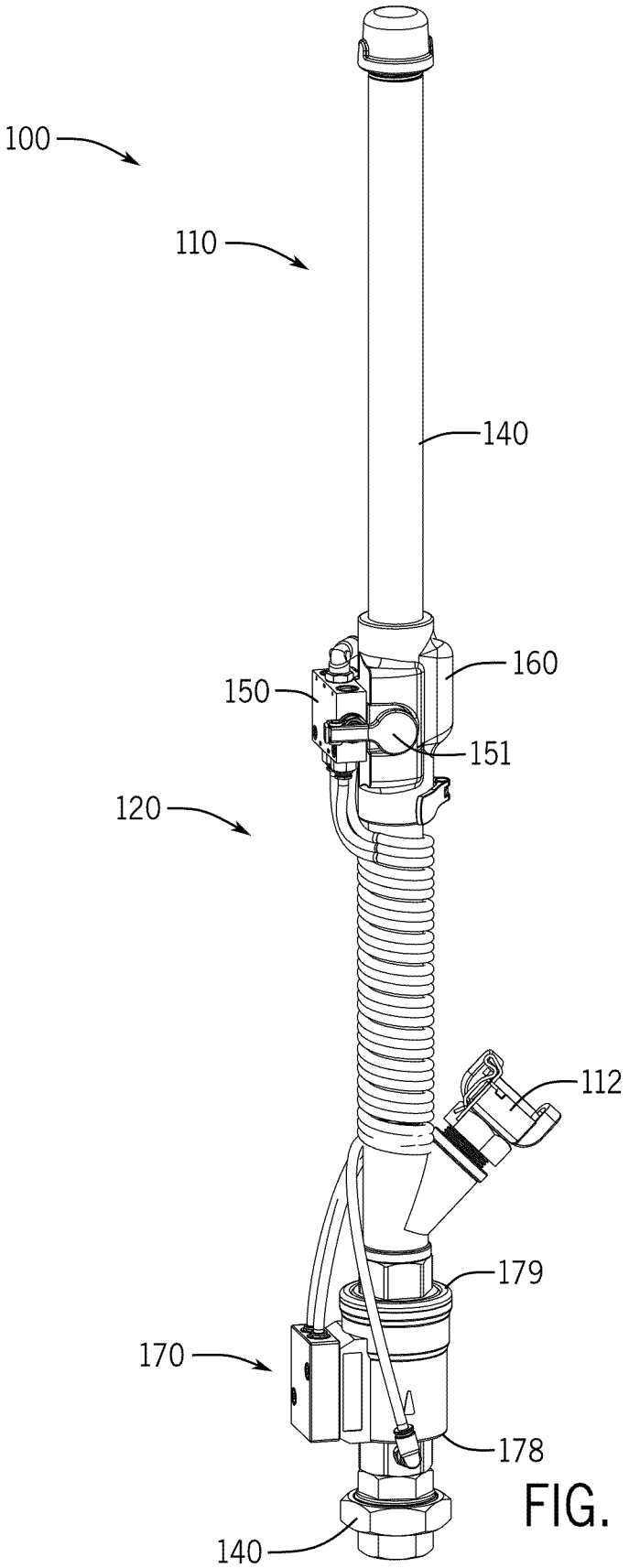
FIG. 2D shows the pneumatic air excavator with an alternative fitting position, according to implementations of the present disclosure.

At the proximal end 110 of the air excavator 100, a port or fitting 112 may be provided for removably connecting to the air supply via the delivery line 111 to establish a fluid coupling to the air supply. For instance the delivery line 111 may include a fitting that is complementary to the fitting 112, or the two may otherwise be configured for coupling to one another directly or indirectly to provide an air tight connection. For instance, the fitting 112 may be a quick connect fitting, a claw connector such as a Chicago claw connector, or other air supply connection. The proximal end 110 may optionally include an angled conduit or pipe 113 and/or a straight conduit or pipe 114, each of which may for instance facilitate ergonomics of using the pneumatic air excavator 100 when coupled to the delivery line 111. Alternatively, the port or fitting 112 may be positioned at a distal end 120 of the air excavator 100, as shown in FIG. 2D, and for instance may be arranged distal to the actuator assembly 150 and the releasable coupling 160. In such case, the barrel 140 extending between the proximal and distal ends 110, 120 may enable the releasable coupling 160 to be moved to various positions along the barrel 140 and locked thereto, and this portion of the barrel 140, in some instances, may not receive airflow from the air supply, and may thereby provide flexibility in the configuration of the releasable coupling 160 and the barrel 140. Arrangement of the port or fitting 112 at the distal end 120 may lower the center of gravity of the pneumatic excavator to a more centralized position, for instance to provide better ergonomics and reduce fatigue. In such examples, the barrel 140 may be arranged both at the inlet end 179 of the flow valve 170 and the outlet end 178 of the flow valve 170 as shown in FIG. 2D.

The distal end 120 of the pneumatic air excavator 100 may define an outlet and may include a nozzle 130 coupled thereto. For instance, the nozzle 130 may be coupled to an egress of the barrel 140, and the nozzle 130 may define an outlet for the pneumatic excavator 100. The nozzle 130 may have various configurations depending on the desired delivery pressure and flow geometry emitted therefrom. For instance, the nozzle 130 may have a supersonic nozzle design. The nozzle 130 may be constructed of various materials such as metal including brass, stainless steel, composites such as polymers, reinforced polymers, a combined construction of metallic and polymer materials, and combinations thereof. The type of nozzle may include but is not limited to 30-300 cubic feet per minute (cfm) at 70 to 250 psi. The nozzle 130 may be interchangeable with other nozzles and may be releasably coupled to the distal end 120 such as via a threaded engagement or other fastening mechanism, e.g., quick connect. Alternatively, the nozzle 130 may be non-detachably connected to the distal end 120 of the pneumatic air excavator 100. In addition or alternatively, the nozzle 130 may include a non-conductive cover or coating, e.g., a rubber, polymer, of the like, for protecting the air excavator 100 and user from electrical shocks during excavation operations near power sources.

In some implementations, the distal end 120 of the pneumatic air excavator 100 may be formed of an optional barrel extension 122 as illustrated in FIG. 1. The barrel extension 122 may have the same or a different configuration as the barrel 140 of the pneumatic air excavator 100 and may be detachably coupled to the barrel 140 such as via a threaded collar or via another fastening mechanism such as those disclosed herein. The barrel extension 122 may enable the user P to use the pneumatic air excavator 100 in excavation applications at varying depths, and for instance, a longer extension 122 may be joined to the barrel 140 when the target object has a depth that is deeper than the length of the barrel 140. This may enable the user P to operate the pneumatic air excavator 100 more comfortably, as the user may operate the system in a standing position instead of a kneeling or bent position. In some implementations, the extension 122 and the barrel 140 may be telescopically arranged, and the length of the pneumatic air excavator 100 may be adjustable, such as by operating an adjustment collar that permits telescopic movement of the extension 122 relative to the barrel 140. The extension 122 may be constructed of the same or different material from the barrel 140, and for instance may be constructed of a non-conductive material such as fiberglass, plastics, rubbers, polymers, lined or coated material, aluminum, and so on.

The barrel 140 may define a portion of the primary flow passage 105 of the pneumatic air excavator 100 for delivering compressed air to the nozzle 130. The barrel 140 may be configured as a rigid, elongated tubular conduit having an ingress and an egress, and the ends may be coupled to various components as described herein, e.g., the ingress may be coupled to the delivery line 111 and the egress may be coupled to the nozzle 130 in a detachable or non-detachable manner. The barrel 140 may be constructed of a non-conductive material such as fiberglass, plastics, rubbers, polymers, lined or coated material, aluminum, and so on. In some implementations, an adjustable shield 142 may be slidably arranged on the barrel 140 proximate the distal end (FIG. 2C). The adjustable shield 142 may be cone-shaped and may deflect debris during an excavation operation.

The actuator assembly 150 of the pneumatic air excavator 100 may be arranged along the barrel 140 as shown in FIGS. 2A, 2C and 2D. The actuator assembly 150 may generally include an actuation switch and may be releasably coupled to the barrel 140 by the releasable coupling 160 described herein. The actuation switch of the actuator assembly 150 may include a trigger 151, e.g., a push button, coupled to a trigger valve 152. The trigger 151 may be biased by a biasing mechanism such as a spring or a solenoid valve. For instance, the trigger valve 152 may include a spool valve with a spool and spool pilot, where the spool is biased by a biasing mechanism such as a spring or solenoid valve, and the trigger 151 may move the spool against the bias force of the biasing mechanism. An actuation conduit 153 may at least be coupled between the actuator assembly 150 and the flow valve 170 and between the safety mechanism 165 and the actuator assembly. The actuation conduit 153 may be movably adjustable as provided herein and may include one or more conduits such as air hoses or conductive wires.

Operation of the actuation switch may cause the pneumatic air excavator 100 to be turned on and off. For instance, to activate the actuator assembly 150, the actuation switch may be moved to a closed position, e.g., by depressing the trigger 151. In response, the actuation conduit 153 coupled between the actuator assembly 150 and the flow valve 170 sends a signal to cause the main valve 170 to move to an open position, such that compressed gas from the delivery line 111 is permitted to pass through the main valve 170 as well as the primary flow passage 105 of the pneumatic air excavator 100 such that the compressed air exits through the nozzle 130. The actuator assembly 150 may be deactivated or released by the actuation switch moving to an open position, e.g., by releasing the trigger 151. Where the trigger 151 includes a biasing mechanism, deactivation may cause the trigger 151 to move to a normal position where the biasing mechanism, e.g., a return spring, is relaxed. In response, the actuation conduit 153 may send a signal to cause the flow valve 170 to move to a closed position to prevent the compressed gas from passing through the main valve 170 and thus the primary flow passage 105. The actuation conduit 153 may be a flexible conduit that can be extended and retracted along the barrel 140 of the pneumatic air excavator 100. For instance, the actuation conduit 153 may be configured as flexible air tubing (e.g., an air actuation conduit), as a flexible electrical conduit (e.g., a conductive wire), and may be coiled around the barrel 140, strung along the barrel 140, e.g., between the actuator assembly 150 and the flow valve 170, or may be telescopic along the barrel 140. In some implementations, a sleeve may cover the actuation conduit 153. The actuation conduit 153 may be provided as one or more conduits. For instance, one, two, three, four, five six, seven or more conduits may be provided in the actuation conduit.

Although the actuator assembly 150 is illustrated as being positioned on the releasable coupling 160, the actuator assembly 150 may alternatively be positioned on the flow valve 170 or another portion of the pneumatic air excavator 100. In addition or alternatively, although the actuator assembly 150 is illustrated as being positioned distal to the flow valve 170, the actuator assembly and, in some cases, the releasable coupling 160 carrying the actuator assembly 150, may alternatively be positioned proximal to the flow valve 170 of the pneumatic air excavator 100.

The releasable coupling 160 may be configured to releasably couple the actuator assembly 150 to the barrel 140 in a plurality of locked positions along a length of the barrel 140 when in a released position, and may be locked or fixed to the exterior 141 of the barrel 140 in the locked position. The releasable coupling 160 may include a sleeve-shaped portion 161 (FIG. 3) surrounding the barrel 140, which may be locked and unlocked by a locking mechanism 162 such as a clamp or a cam lock, e.g., clamping handle coupled to a split ring or clamp, for establishing a pinch, compression, and/or friction lock. The locking mechanism 162 may engage with the barrel 140 via a pinch or clamping mechanism along the external diameter of the barrel 140. In an unlocked position of the locking mechanism 162, the releasable coupling 160 may be in a released position and be moved or slid along the exterior 141 of the barrel 140, and due to the actuation conduit 153 being adjustable or flexible, movement of the releasable coupling 160 slaves the actuation conduit 153 along the barrel 140 of the pneumatic air excavator 100 (e.g., in an expansion or a retraction movement) and thus the coupling between the actuator assembly 150 and the flow valve 170 via the actuation conduit 153 can be maintained in any position of the actuator assembly 150 relative to the flow valve 170. The locking mechanism 162 of the releasable coupling 160 may be moved to a locked position to secure or lock the releasable coupling 160 to the exterior 141 of the barrel 140.

Figure 5A:
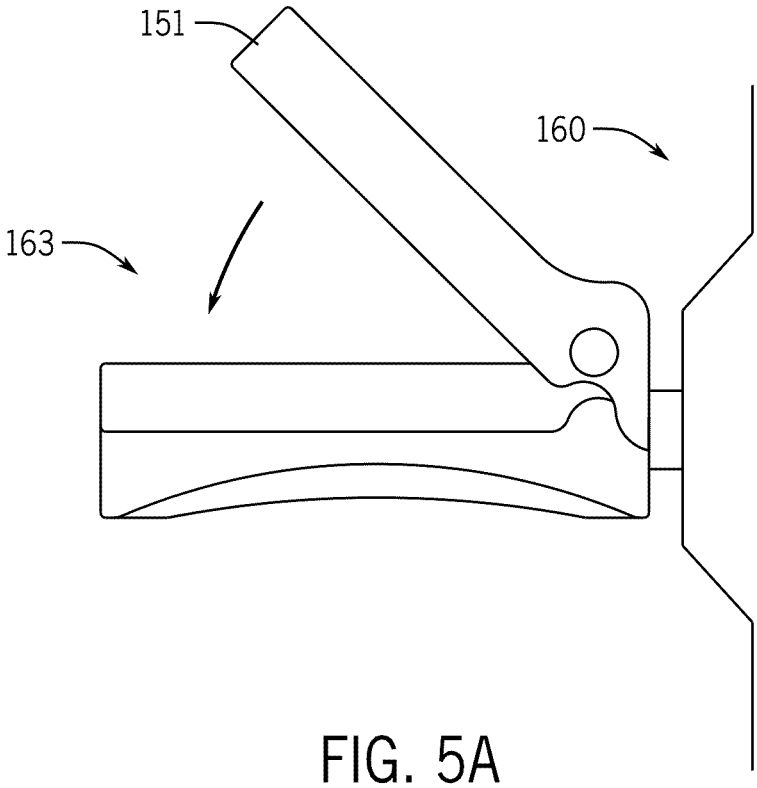
FIGS. 5A and 5B illustrate different positions of a handle of the pneumatic air excavator, according to implementations of the present disclosure.
Figure 5B:
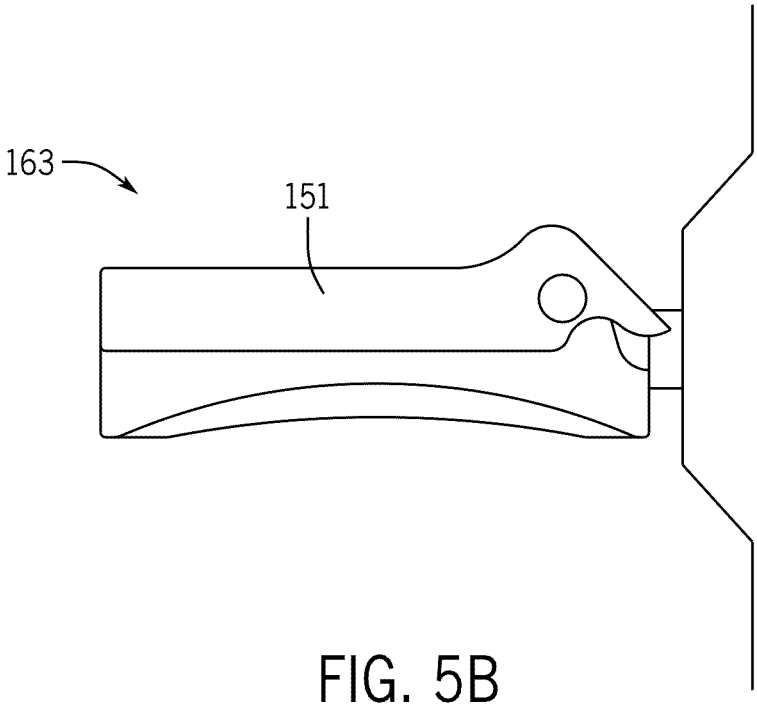

In some implementations, the sleeve-shaped portion 161 of the releasable coupling 160 may include the trigger 151 of the actuator assembly 150 coupled thereto, and for instance the trigger 151 may be arranged on or in the sleeve-shaped portion 161 to provide a user with a grippable portion via the sleeve-shaped portion that can be simultaneously used to actuate the actuator assembly 150 via the trigger 151 between an on and off state. In some implementations, the releasable coupling 160 may additionally include a handle 163 (FIGS. 5A and 5B), which may extend from the sleeve-shaped portion 161 and/or may be integrated with the sleeve-shaped portion 161. As shown in FIGS. 5A and 5B, the trigger 151 of the actuator assembly 150 may be integrated with the handle 163 of the releasable coupling 160 and the trigger 151 may be movable between an off position (FIG. 5A) and an on position (FIG. 5B). In some implementations, the handle 163 may be positioned perpendicularly, at an angle, or parallel relative to the releasable coupling 160 and the barrel 140. In addition, the handle 163 may be an adjustable handle that is adjustable to the aforementioned positions. It will be appreciated that the actuator assembly 150 and releasable coupling 160 may be integrated into an assembly configured to be held or gripped by a single hand of the user P to facilitate ergonomics and use of the pneumatic air excavator 100. In further implementations, a second handle 143 (FIG. 2C) may be releasably coupled to the barrel 140 using a second releasable coupling 144, e.g., a cam lock or clamp, and may be configured to be movable to a plurality of locked positions along the length of the barrel 140 independent from the releasable coupling 160.

In some implementations, a safety mechanism 165 may be included with the air excavator 100 configured to require actuation of primary and secondary actuators for the pneumatic excavator 100 to operate, which actuators may be arranged such that both hands of a user are required for actuation, e.g., by depressing the two actuators using separate hands. This may ensure that the operator always has two hands on the pneumatic excavator 100 during operation and reduces the chances of an accidental discharge. Accordingly, the safety mechanism 165 may include a secondary trigger or actuator 166, which may be operated in combination with the actuator 150 (e.g., the actuation switch or trigger 151) in order for the user to operate of the pneumatic excavator 100. The actuator 150 is also referred to as a primary actuator for purposes of discussion in connection with the secondary actuator 166. Depressing both the primary and secondary actuators 150, 166, respectively, may result in completion of a circuit that enables the flow valve 170 to receive a signal that causes movement to the open position (FIG. 4B) and flow of air through the primary passage 105. In such examples, depressing only one of the primary and secondary actuators 150, 166 may result in the flow valve 170 remaining in a closed position or moving to a closed position (FIG. 4A) for instance due to providing an incomplete circuit, such that the flow valve 170 is held in a closed position and/or is prevented from receiving a signal that otherwise can cause movement to the open position. The safety mechanism 165 may be coupled to the primary actuator 150 via the conduit 153, which may include an air hose 154*d* (FIG. 2B) and for instance the signal may be an air signal, such as compressed air. Alternatively, the conduit 153 may be configured to carry an electrical signal. The safety mechanism 165 may be arranged along the barrel 140 in a separate location from the actuator 150. In some implementations, a releasable coupling 160' (FIG. 2A), e.g., a second releasable coupling, may include the safety mechanism 165 or components thereof integrated therein, and the releasable coupling 160' may be used to lock the safety mechanism 165 to the barrel 140. For instance, as shown in FIG. 2B, the actuator 166 of the safety mechanism may be provided on the releasable coupling 160' and arranged along the barrel 140 in a location separate from the other releasable coupling 160 and the primary actuator 150. Accordingly the releasable couplings 160, 160' and their respective trigger 151 and actuator 166 may be movable relative to each other along the length of the barrel 140.

Figure 3:
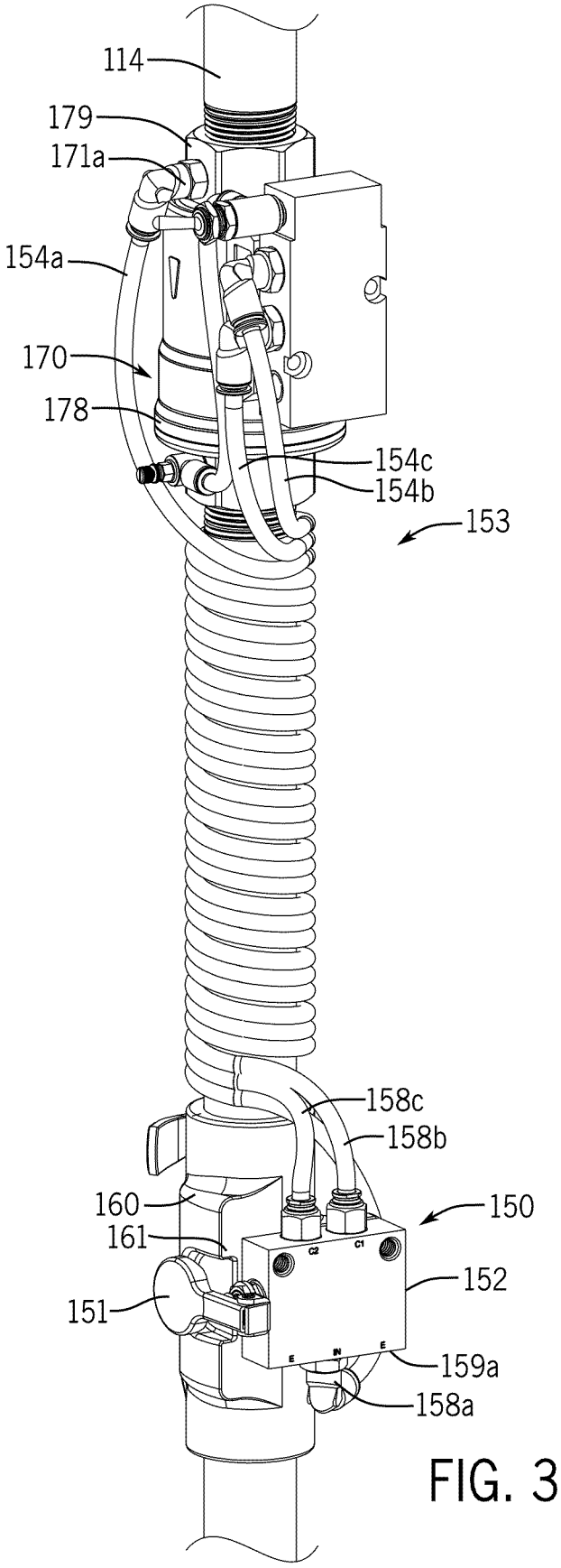
FIG. 3 illustrates a detail view of components of the pneumatic air excavator, according to implementations of the present disclosure.
Figure 4A:
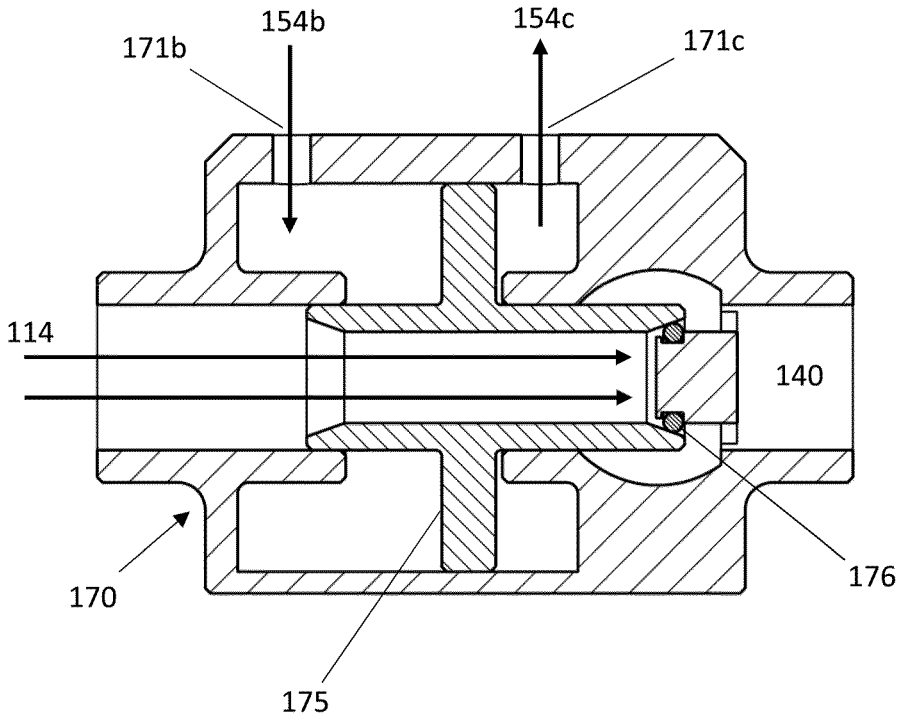
FIGS. 4A and 4B illustrate a valve of the pneumatic air excavator in a closed position and in an open position, respectively, according to implementations of the present disclosure.
Figure 4B:
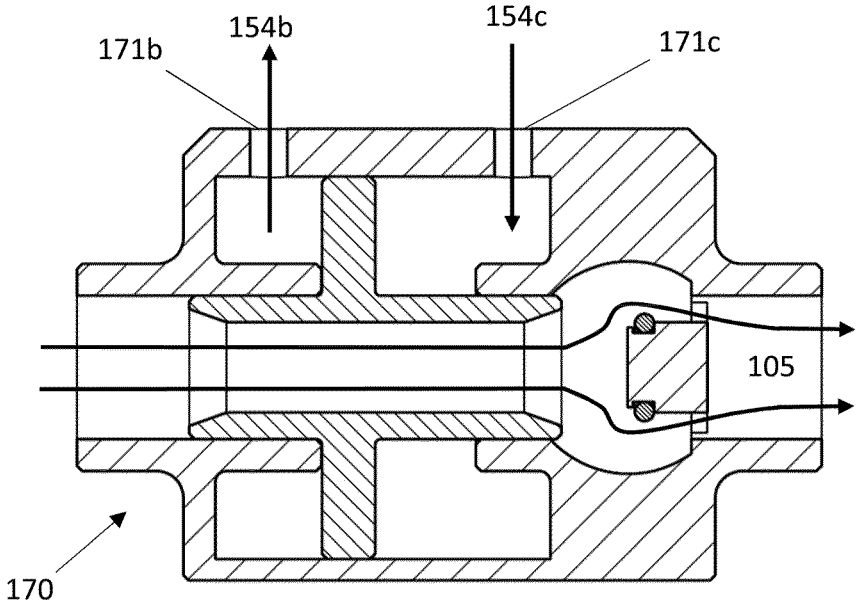

The flow valve 170 also referred to as a primary valve or main valve of the pneumatic excavator 100 may be arranged between the pipe 114 and the barrel 140 as illustrated in FIGS. 4A and 4B and may be responsible for delivering airflow through the pneumatic air excavator when in the actuated or open position. Referring to FIGS. 3, 4A and 4B, the flow valve 170 may include ports 171*a*, 171*b*, 171*c*, a piston 175, a valve seat 176, an outlet end 178 and an inlet end 179, where the portion of the flow valve 170 defining the primary flow passage 105 extends therebetween. In some implementations the flow valve 170 may be free of a return spring, such as where the flow valve 170 is pneumatically operated, while in other implementations, a mechanical biasing mechanism such as a return spring may be included in the flow valve 170. The flow valve 170 may be configured as a pneumatically piloted valve such as a coaxial valve, a double acting coaxial valve, or as a solenoid actuated coaxial valve, as a pneumatic actuated angle seat valve or as a pneumatically actuated ball valve.

Ports 171*a*, 171*b*, and 171*c* of the flow valve 170 may be coupled to the actuator assembly 150 via the actuation conduit 153. For instance, referring to FIGS. 2B and 3, the actuation conduit 153 may include at least two flexible air hoses, such as three air hoses 154*a*, 154*b*, and 154*c*. Air hose 154*a* may be configured as a constant pressure conduit, a first end of which may be coupled to the pneumatic air excavator 100 at a port 171*a* upstream from the piston 175 of the flow valve 170, and the air hose 154*a* may extend to and be coupled to the actuator assembly 150, e.g., at port 158*a*, at a second end. Although the port 171*a* is illustrated as being defined in the flow valve 170, it will be understood that the port 171*a* may be defined in other portions of the pneumatic excavator 100 upstream from the flow valve 170. The air hose 154*a* may be constantly supplied compressed air when the delivery line 111 transmits pressurized air. Air hoses 154*b*, 154*c* may each be coupled to respective other ports 171*b*, 171*c* of the main valve 170 and to respective ports 158*b*, 158*c* of the housing 157 of the actuator assembly 150.

In implementations of use, the pneumatic air excavator 100 may be pneumatically turned on and off using the same compressed air supply that is used to operate the pneumatic air excavator 100. For instance, the actuation conduit 153 may include air hoses, e.g., air hoses 154*a*, 154*b*, and 154*c*. The air hoses may receive compressed air from the delivery line 111 or may carry compressed air emitted from the actuator assembly 150 to the flow valve 170. For instance, the compressed air received by the actuator assembly 150 may be derived from the air supply from the delivery line 111, and thus the actuator assembly 150 may receive the same compressed air supply that is used to operate the pneumatic air excavator 100, e.g., when the flow valve 170 is open and the compressed air passes through the primary flow passage 105.

In such implementations, actuation of the trigger 151 of the actuator assembly 150 may open a valve of the trigger valve 152, e.g., by movement of a spool against a biasing mechanism such as a return spring, to cause pressurized air from the actuator assembly 150 to enter the actuation conduit 153, e.g., air hose 154*c*, fluidly coupled to the main valve 170, and the actuation conduit 153 may deliver the pressurized air to a port, e.g., port 171*c*, of the main valve 170 to cause the main valve 170 to open and thereby permit pressurized air to flow through primary flow passage 105 of the pneumatic air excavator 100. Release of the trigger 151 may cause the trigger valve 152 to relax, for instance as a biasing force is released such as via relaxation of a spring, which may also cause pressurized air from the air supply to enter the actuation conduit 153, e.g., at air hose 154*b*, and be delivered to the main valve 170, but the pressurized air may be routed to another port, e.g., port 171*b* of the main valve 170 to close the main valve 170 and thereby prevent pressurized air from flowing through the primary flow passage 105 and exit the nozzle 130. Thus, the actuator assembly and the air hoses of the actuation conduit 153 may be configured to enable the actuator assembly 150 to pneumatically actuate and deactivate the pneumatic air excavator 100.

In implementations of use, the releasable coupling 160 may be movable along the barrel 140 at various stages of use of the pneumatic air excavator 100. For instance, the releasable coupling 160 may be used to adjust the position of the actuator assembly 150 prior to delivering compressed air through the delivery line 111, however, the releasable coupling 160 may be operated while the compressed air 111 is active. In examples, the trigger 151 of the actuator assembly 150 may be in an open, un-depressed state, the releasable coupling 160 may be unlocked, moved to a selected position, locked to the barrel 140, and then the trigger 151 may be depressed in an excavating operation. In other examples, the trigger 151 may be depressed in connection with an excavating operation while the releasable coupling is unlocked, moved to a new position, and locked to the barrel 140.

In some implementations of use, at least a portion of the actuator assembly 150 and releasable coupling 160 may be held by one hand of the user P to turn on and off the pneumatic air excavator 100. Due to the releasable coupling 160 being movable, the pneumatic air excavator 100 may be simplified because the user is allowed to select where along the barrel 140 to the actuator assembly 150 should be positioned and operated, for instance, depending on how the pneumatic air excavator 100 is being used or intended to be used, and move the releasable coupling 160 to the selected position. In addition to selecting where the user's hand will be on the air excavator 100 when operating the actuator assembly 150, this flexibility may also facilitate operation due to the ability to adjust and select where the user's other hand is positioned on the pneumatic air excavator 100 relative to the other hand on the actuator assembly 150. Thus, the releasable coupling 160 may provide an ergonomic approach to air excavation and operational control that has not otherwise not been possible.

Figure 6A:
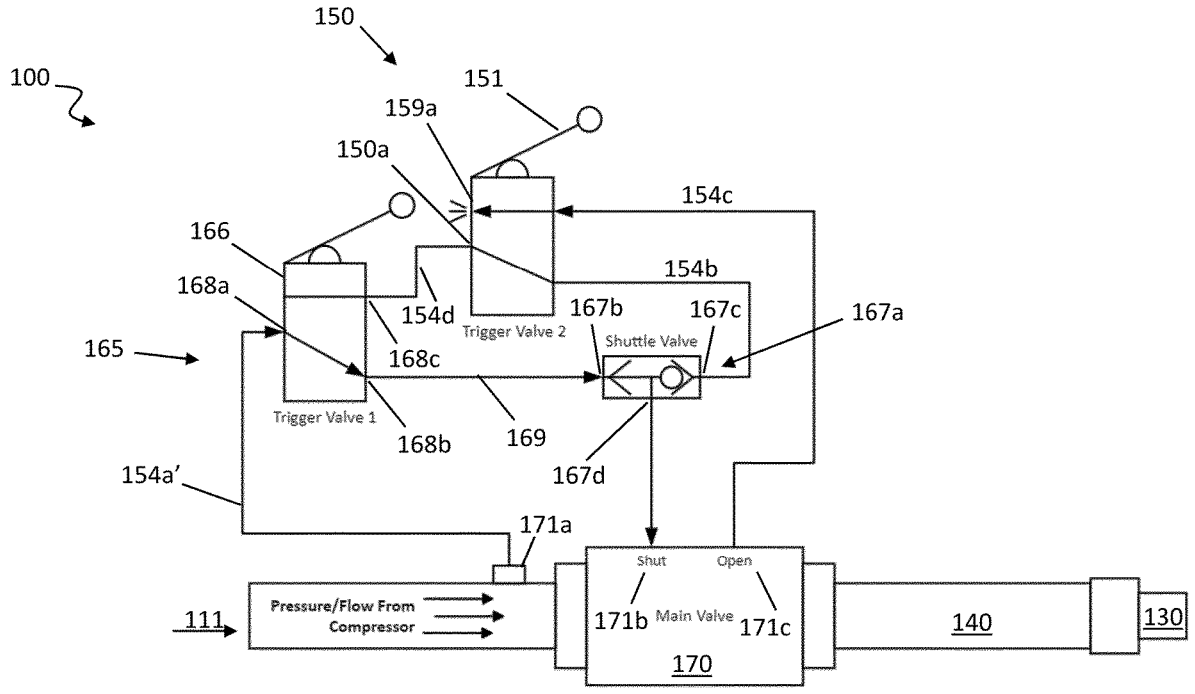
FIGS. 6A-6C illustrate pneumatic circuit diagrams of the pneumatic excavator including a safety mechanism, according to implementations of the present disclosure.
Figure 6B:
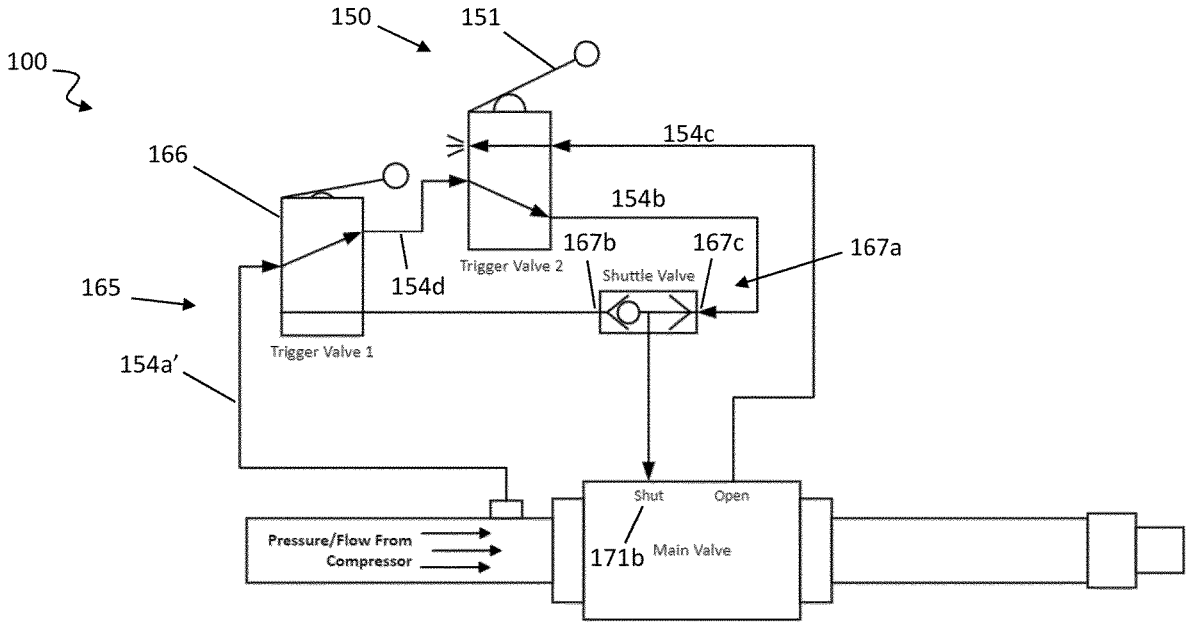
Figure 6C:
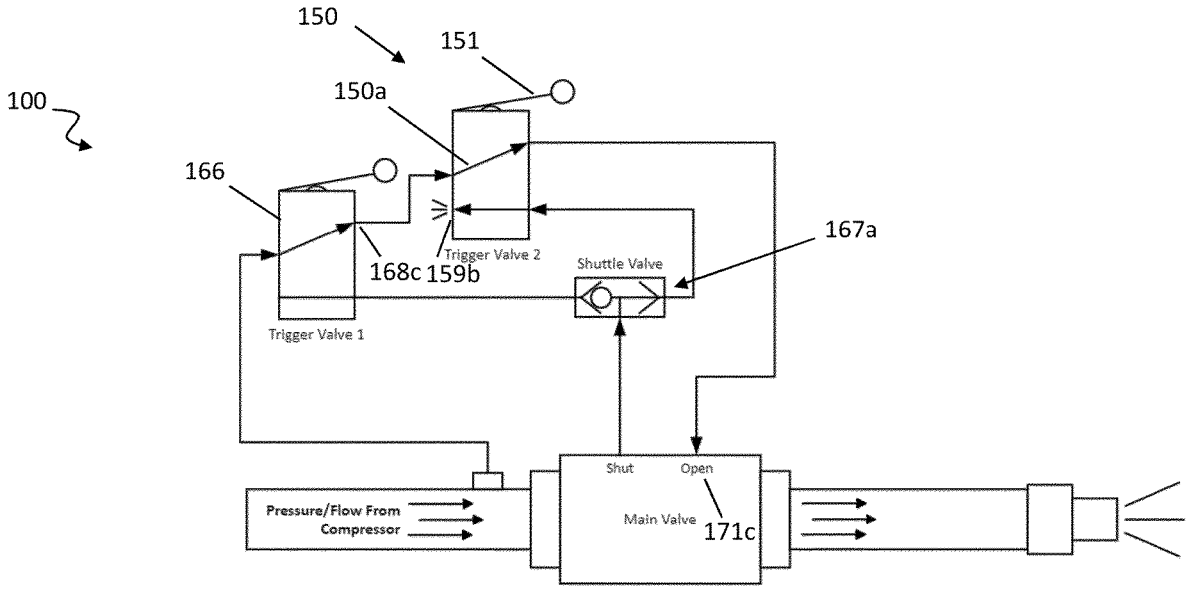

With reference to FIGS. 6A-6C, the pneumatic excavator 100 may include the safety mechanism 165 configured to receive an air signal such as compressed air. In this case, the secondary actuator 166 may be configured as a valve for receiving and transmitting compressed air, such as a spool valve. The secondary actuator 166 may be actuated, for instance, using a trigger of the secondary actuator 166. The secondary actuator may be fluidly coupled to at least one air conduit. For instance, the actuator 166 may include an intake port 168*a* configured to constantly receive compressed air, such as from a constant pressure conduit 154*a*' configured to receive compressed air from a port upstream of the flow valve 170, and may be configured with a delivery port 168*b* for coupling via an air delivery conduit 169 to a shuttle valve 167*a*, as well as another delivery port 168*c* for coupling via an air delivery conduit to an intake port 150*a* the primary actuator 150. For instance, the air hose 154*d* may be configured as a constant pressure conduit configured to conditionally receive an air signal from the constant pressure conduit 154*a*' such as when the secondary actuator 166 is in an actuated or closed position.

FIG. 6A illustrates an initial state of the secondary actuator 166 of the safety mechanism 165 prior to actuation, such as in a normal position of the secondary actuator 166 configured as a valve spool biased by a biasing mechanism. In the initial state, the pressure signal entering the secondary actuator 166 may be routed into the shuttle valve 167*a*. The shuttle valve 167*a* may include an entry or intake port on each side 167*b*, 167*c*, and a separate exit or delivery port 167*d*, e.g., on the bottom. The shuttle valve 167*a* may allow air flow through the entry port with the higher pressure, and blocks the entry of air flow into the entry port having the lower pressure. In FIG. 6A, the intake port 167*b* of the shuttle valve is pressurized via air delivery conduit 169, e.g., an air hose, and the intake port 167*c* is vented back to atmosphere at this phase via, flow is allowed from the intake port 167*b* to the exit port 167*d* and the intake port 167*c* is blocked-off. The pressure signal from the exit port 167*d* of the shuttle valve 167*a* is directed into the port 171*b* of the main valve 170, ensuring that the main valve 170 remains shut while both actuators 166, 150 are in the initial state or normal position. The shuttle valve 167*a* may prevent the pressure signal from the secondary actuator 166 from looping back through primary actuator 150 and venting to atmosphere. At this phase, if the primary actuator 150 was actuated but not the secondary actuator 166, no change would occur since no pressure signal is provided at the intake port 150*a* of the actuator 150. In addition, any entrapped air at the port 171*c* of the main valve 170 may be vented through vent port 159*a* of the actuator assembly 150 via the air hose 154*c*.

With reference to FIG. 6B, once the secondary actuator 166 is actuated, e.g., depressed, the pressure signal may instead be routed into the entry or intake port 150*a* of the primary actuator 150 for instance via a conduit or air hose 154*d* configured to conditionally receive an air signal from the constant pressure conduit 154*a*' when the secondary actuator 166 is actuated. In the state of FIG. 6B, the conduit 154*d* may also function as a constant pressure conduit by receiving a constant supply of compressed air when the delivery line 111 is transmitting pressurized air to the pneumatic excavator 100. If the primary actuator 150 is in the initial or normal position, then the pressure signal may be routed into the shuttle valve 167*a*. At this phase the intake port 167*b* of the shuttle valve is routed to atmosphere, so the pressure signal at the other intake port 167*c* is passed to the exit or delivery port 167*d*, and the intake port 167*b* is blocked. Again, the pressure signal at the exit port 167*d* may be routed to the port 171*b* of the main valve 170, ensuring that the main valve 170 remains shut even if one of the two actuators is depressed. In addition, any entrapped air at the port 171*c* of the main valve 170 may be vented through vent port 159*a* of the actuator assembly 150 via the air hose 154*c*.

With reference to FIG. 6C, a next phase of operation is illustrated when both the primary and secondary actuators 150, 166 are actuated. With the secondary actuator 166 depressed the air signal is routed into the entry or intake port 150*a* of the actuator 150. With the actuator 150 actuated, e.g., the trigger 151 depressed, the air signal may then be routed into the port 171*c* of the main valve 170 thereby forcing the main valve 170 into an open position. Entrapped air in the main valve 170 received from port 171*b* may then exit this port 171*b* and be routed through the shuttle valve 167*a* and vented through one of the actuators 166, 150, e.g., at vent port 159*b* of the primary actuator 150 and vented to atmosphere.

Figure 7:
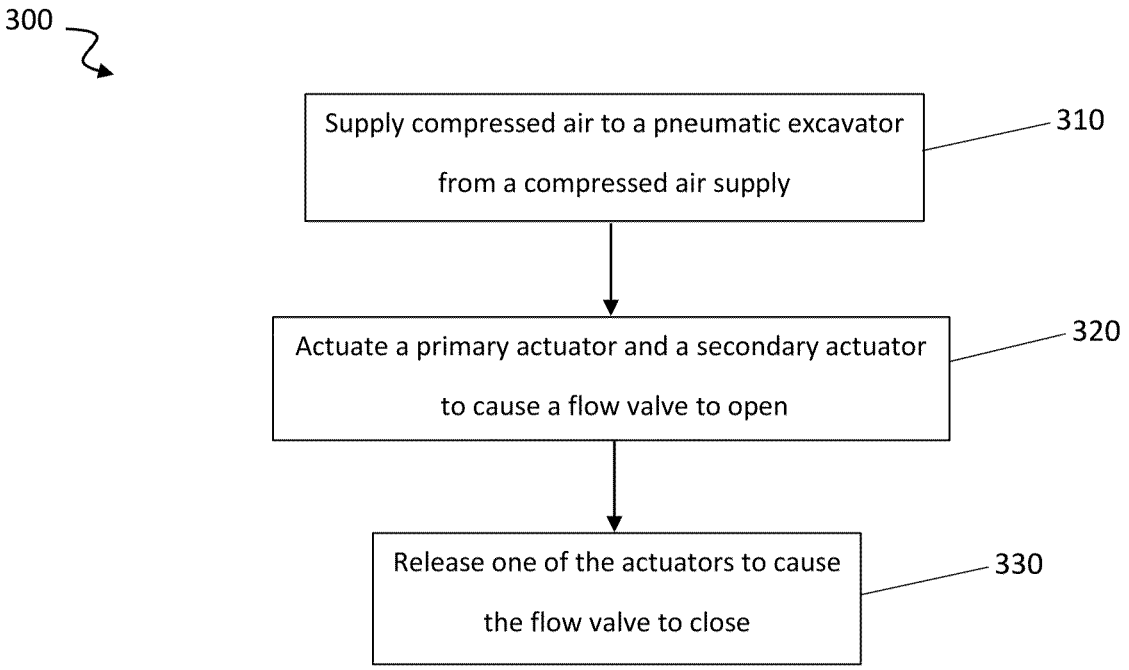
FIG. 7 illustrates a flow diagram of a method of actuating the pneumatic air excavator, according to implementations of the present disclosure.

According to implementations of use, as shown in the flow diagram of FIG. 7, a method 300 of operating a pneumatic excavator 100 including a safety mechanism 165 may involve, in operation 310, supplying compressed air to the pneumatic excavator 100 from a compressed air supply, e.g., via delivery line 111. The method 300 may continue by actuating the primary actuator 150 and the secondary actuator 166 of the safety mechanism 165 in operation 320 to cause compressed air to be transmitted from the secondary actuator 166 to the primary actuator 150 and then to the flow valve 170 to cause the flow valve 170 to move to an open position (FIG. 4B) such that the compressed air from the supply of compressed air passes through the primary flow passage 105 and exits the pneumatic excavator 100. Actuating one of the primary or secondary actuators 150, 166 and not actuating the other in operation 330 may cause the compressed air to be transmitted to the shuttle valve 167*a* to the flow valve 170 to cause the flow valve 170 to move to a closed position (FIG. 4A) such that the compressed air from the supply of compressed air is prevented from passing through the flow valve 170.

For instance, in operation 310, the compressed air may be supplied via delivery line 111 to the inlet end 179 of the flow valve 170 such that the compressed air enters the constant pressure conduit 154*a*' and is received by an intake port of the secondary actuator 166 of the safety mechanism 165.

Prior to actuation of the actuators in operation 320 of method 300, the compressed air supply may be prevented from passing through the barrel 140 and exiting the nozzle 130 due to the flow valve 170 being in a closed position (FIG. 4A) and the primary or secondary actuator 150, 166 routing pressurized air to the shuttle valve 167*a*, which transmits the compressed air to the flow valve 170 to retain or move the piston 175 to seal against a valve seat 176 of the flow valve 170 (FIG. 4A). For instance, the constant pressure conduit 154*a*' may receive the compressed air from the port 171*a* positioned upstream of the piston 175 such that the compressed air is permitted to constantly pass through the constant pressure conduit 154*a*' and to the secondary actuator 166 as long as the delivery line 111 is supplied with compressed air. Where the secondary actuator 166 is open, e.g., unactuated, the compressed air is routed from the secondary actuator 166 to the port 171*b* of the flow valve 170 via the exit port 167*d* of the shuttle valve 167*a* to close or retain the flow valve 170 in a closed position. Where the secondary actuator 166 is closed, e.g., actuated, but the primary actuator 150 is open, e.g., unactuated, the compressed air is received at the primary actuator 150 from the air hose 154*d*, e.g., configured as a conditional constant pressure conduit, but again is routed to the port 171*b* of the flow valve 170 via the exit port 167*d* of the shuttle valve 167*a*, to again close or retain the flow valve in the closed position. Thus, the pneumatic excavator 100 is provided with a safety mechanism permitting operation, e.g., air flow through the primary flow path 105, only when both actuators are actuated.

Returning to method 300, upon actuating the primary actuator 150 and the secondary actuator 166 in operation 320, the actuator assemblies may each move to a closed position, and compressed air may be transmitted from the constant pressure conduit 154*a*', air hose 154*d* and through the air hose 154*c* of the actuation conduit 153, to the flow valve 170 to cause the flow valve 170 to move to an open position (FIG. 4B) where the compressed air from the compressed air supply passes from the delivery line 111 and through the primary flow passage 105 of the pneumatic excavator 100 and exits the nozzle 130. In the open position of the flow valve 170, the piston 175 is pushed away from the valve seat 176 to permit air to pass through. In this state of the actuators 150, 166, the shuttle valve 167*a* may not receive compressed air. For instance, when both actuators 150, 166 are first depressed and the piston 175 shifts to the open position there may be an initial venting of air from port 171*b*, which may exit shuttle valve 171*a* and to atmosphere. After this initial venting the shuttle valve 171*a* may remain open to atmosphere on both intake ports until one or both of the actuators 150, 166, e.g., triggers 151 and/or trigger of the secondary actuator 166, has been released.

Releasing one or the other primary or secondary actuator 150, 166, e.g., while keeping the other actuated in operation 330, may result in the airflow from the constant pressure conduit 154*a*' being routed to the shuttle valve 167*a* to thereby cause the flow valve 170 to again move to the closed position (FIG. 4A). For instance, during the actuating of one of the primary actuator 150 or the secondary actuator 166 and not actuating the other, the shuttle valve 167*a* allows air to enter one entry port 167*b* or 167*c* from the actuated actuator and prevents air from entering the other entry port. In some implementations, the flow valve 170 is a pneumatic valve requiring the delivery of compressed air to one of its ports 171*b* and 171*c* in order to open and close, and accordingly the flow valve 170 may be free of a biasing mechanism such as a return spring.

Accordingly, the actuator assembly 150 and safety mechanism 165 may together be configured to pneumatically actuate the flow valve 170 via completion of an air circuit from the constant pressure conduit 154*a*' to the flow valve 170 via the air hose 154*d* and the air hose 154*c*, as provided herein. In addition, as provided herein, the actuator 150 and the safety mechanism 165 may be remotely arranged from each other and from the flow valve 170 as illustrated in the Figures. Pneumatically actuating the pneumatic air excavator 100 may provide advantages because use of pressurized air as a means to trigger the flow valve 170 provides an efficient use of pressurized air at the safety mechanism 165 and the actuator assembly 150 where a small air signal may be used, e.g., via the safety mechanism 165 and actuator assembly 150 including the aforementioned conduits, results in a short throw length or relay to cause a large pressure change at the flow valve 170 to cause the flow valve 170 to close and open (FIGS. 4A and 4B). A coaxial-style valve as illustrated in these figures, as well as other pneumatic valves such as ball or angled seat, may thus be operated using a small mechanical operator, like the trigger 151 and secondary actuator 166, to cause pressurized air to flow through the flow valve 170 as provided herein.

Venting may occur during operation of the compressed air excavator 100 to cause opposing pressure to be vented to the atmosphere. In some implementations, the flow valve 170 may be vented via one or more ports 171*b*, 171*c* when the valve is in the open and/or closed position to facilitate reliable operation of the pneumatic air excavator in the on and off positions. For instance, when the flow valve 170 is in the closed position of FIG. 4A, e.g., due to the compressed air from air hose 154*b* entering port 171*b* of the flow valve 170 and forcing the piston 175 against the valve seat 176, any entrapped air present in the port 171*c* may be vented, for instance through the air hose 154*c* and to an exhaust port 159*a* (FIG. 3) of the actuator assembly 150. Similarly, when the flow valve 170 is in the open position of FIG. 4B, e.g., due to the compressed air from the air hose 154*c* entering port 171*c* of the flow valve and forcing the piston 175 away from the valve seat 176, any air present in the port 171*b* may be vented, for instance through the air hose 154*b* and to the exhaust port 150 of the actuator assembly 150. In addition or alternatively, entrapped air in the main valve 170 received from port 171*b* may exit this port 171*b* when the flow valve 170 is moved to an open position, and the entrapped air may be routed through the one of the actuators 166, 150, e.g., through exhaust or vent ports described herein and vented to atmosphere. In some implementations, the flow valve 170 may include a mechanical biasing mechanism such as a return spring to facilitate movement of the piston 175 to the closed position.

In some implementations, the actuator assemblies and the controller valves may be biased such as spring loaded. For instance, depressing the trigger 151 against a spring force may cause trigger valve 152 to shift from its initial or normal position and the flow valve 170 to move to an open or on position as provided herein. When the trigger 151 is released, the spring relaxes and may cause the trigger valve 152 to shift back to its initial or normal position, which may cause the flow valve 170 to move to the closed or off position as provided herein.

Various changes may be made in the form, construction and arrangement of the components of the present disclosure without departing from the disclosed subject matter or without sacrificing all of its material advantages. The form described is merely explanatory, and it is the intention of the following claims to encompass and include such changes. Moreover, while the present disclosure has been described with reference to various embodiments, it will be understood that these embodiments are illustrative and that the scope of the disclosure is not limited to them. Many variations, modifications, additions, and improvements are possible. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A pneumatic excavator configured to be pneumatically actuated, comprising:

a primary actuator;

a secondary actuator fluidly coupled to the primary actuator;

a shuttle valve comprising a first inlet port fluidly coupled to a delivery port of the primary actuator, a second inlet port fluidly coupled to a delivery port of the secondary actuator;

a flow valve comprising a first port fluidly coupled to the primary actuator by at least one air actuation conduit and a second port fluidly coupled to an exit port of the shuttle valve; and a barrel coupled to an egress of the flow valve, wherein an egress of the barrel defines an outlet of the pneumatic excavator, wherein a primary flow passage is defined at least by the flow valve and the barrel, wherein actuating the primary actuator and the secondary actuator causes compressed air to be transmitted from the secondary actuator to the primary actuator and through the at least one air actuation conduit to the first port of the flow valve to cause the flow valve to move to an open position such that the compressed air from a supply of compressed air passes through the primary flow passage and exits through the outlet of the pneumatic excavator to break apart soil, and wherein actuating one of the primary actuator or the secondary actuator and not actuating the other causes the compressed air to be transmitted to the exit port of the shuttle valve fluidly coupled to the second port of the flow valve to cause the flow valve to move to a closed position, wherein in the closed position, the flow valve prevents the compressed air from the supply of compressed air from passing therethrough.

2. The pneumatic excavator of claim 1, further comprising a constant pressure conduit, wherein a first end of the constant pressure conduit is coupled to the pneumatic excavator at an upstream position from the egress of the flow valve, and a second end of the constant pressure conduit is coupled to the secondary actuator.

3. The pneumatic excavator of claim 2, further comprising an air conduit fluidly coupling the primary actuator to the secondary actuator, wherein when the secondary actuator is actuated, the air conduit is fluidly coupled to the constant pressure conduit.

4. The pneumatic excavator of claim 3, wherein the primary actuator further comprises a primary actuator valve, wherein as the secondary actuator is actuated and when the primary actuator is actuated, the primary actuator valve is configured to fluidly couple the constant pressure conduit to the first port of the flow valve.

5. The pneumatic excavator of claim 3, wherein as the secondary actuator is actuated and the primary actuator is not actuated, the delivery port of the primary actuator fluidly couples the air conduit to the first inlet port of the shuttle valve.

6. The pneumatic excavator of claim 2, wherein the secondary actuator further comprises a secondary actuator valve, wherein when the primary actuator is actuated and the secondary actuator is not actuated, the delivery port of the secondary actuator valve is configured to fluidly couple the constant pressure conduit to the second inlet port of the shuttle valve.

7. The pneumatic excavator of claim 1, wherein when neither the primary actuator nor the secondary actuator are actuated, the secondary actuator is configured to transmit the compressed air via the delivery port to the second inlet port of the shuttle valve such that the flow valve is retained in the closed position or caused to move to the closed position, wherein in the closed position, the flow valve prevents the compressed air from the supply of compressed air from passing therethrough.

8. The pneumatic excavator of claim 1, wherein at least one of the primary actuator or the secondary actuator comprises a spool valve including a spool biased by a biasing mechanism.

9. The pneumatic excavator of claim 8, wherein the biasing mechanism comprises a return spring.

10. The pneumatic excavator of claim 1, wherein in the closed position of the flow valve, a piston of the flow valve seals against a valve seat.

11. The pneumatic excavator of claim 1, further comprising at least one vent port configured to vent compressed air from the flow valve.

12. The pneumatic excavator of claim 11, wherein the at least one vent port is defined in the primary actuator or the secondary actuator.

13. The pneumatic excavator of claim 1, wherein the flow valve is free of a biasing mechanism such that the flow valve requires the compressed air to move the flow valve to the open position and to the closed position.

14. A method of pneumatically actuating a pneumatic excavator, comprising:

supplying compressed air to a pneumatic excavator from a compressed air supply, the pneumatic excavator comprising an elongated barrel, a primary actuator, a secondary actuator, and a flow valve, the elongated barrel having an ingress and an egress, said ingress configured to be fluidly connected to the compressed air supply, said egress defining an outlet of the pneumatic excavator, the primary actuator comprising at least one air actuation conduit and the primary actuator configured to be fluidly coupled to a shuttle valve, the secondary actuator fluidly coupled to the primary actuator and to the shuttle valve, the flow valve fluidly coupled to the primary actuator and to the shuttle valve, wherein a primary flow passage is defined at least by the flow valve and the barrel;

actuating the primary actuator and the secondary actuator to cause the compressed air to be transmitted from the secondary actuator to the primary actuator to the flow valve to cause the flow valve to move to an open position such that the compressed air from the compressed air supply passes through the primary flow passage and exits through the outlet of the pneumatic excavator to break apart soil, and actuating one of the primary actuator or the secondary actuator and not actuating the other to cause the compressed air to be transmitted to the shuttle valve to the flow valve to cause the flow valve to move to a closed position such that the compressed air from the compressed air supply is prevented from passing through the flow valve.

15. The method of claim 14, wherein during the supplying of compressed air, further comprising constantly delivering the compressed air to a constant pressure conduit fluidly coupled to an intake port of the secondary actuator.

16. The method of claim 15, wherein the actuating one of the primary actuator or the secondary actuator and not the other includes actuating the secondary actuator and not the primary actuator, and wherein the air actuation conduit further comprises a first air actuation conduit fluidly coupling the primary actuator and the secondary actuator such that the compressed air is constantly delivered to the air actuation conduit and to the primary actuator.

17. The method of claim 15, wherein the air actuation conduit further comprises a first air actuation conduit and a second air actuation conduit, wherein during the actuating of the primary actuator and the secondary actuator, the first air actuation conduit fluidly couples the primary actuator and the secondary actuator such that the compressed air is constantly delivered to the first air actuation conduit and to the primary actuator, and the second air actuation conduit fluidly couples the primary actuator and the flow valve such that the compressed air is constantly delivered from the primary actuator to the flow valve.

18. The method of claim 15, wherein the actuating one of the primary actuator or the secondary actuator and not the other includes actuating the primary actuator and not the secondary actuator, and wherein the secondary actuator further comprises an air conduit fluidly coupling a delivery port of the secondary actuator and the shuttle valve such that the compressed air is constantly delivered to the shuttle valve via the air conduit.

19. The method of claim 14, wherein during the actuating of one of the primary actuator or the secondary actuator and not actuating the other, the shuttle valve allows air to enter an entry port from an actuated actuator of the primary actuator or secondary actuator and prevents air from entering the shuttle valve from the other actuator.

20. The method of claim 14, wherein the flow valve is free of a biasing mechanism such that the flow valve requires the compressed air to move the flow valve to the open position and to the closed position.

* * * * *